United States Patent [19]

Marcandalli

[11] Patent Number: 4,616,585

[45] Date of Patent: Oct. 14, 1986

[54] DEVICE PROVIDING FOR THREE SEWING MACHINE NEEDLE STROKES

[75] Inventor: Ulderico Marcandalli, Milan, Italy

[73] Assignee: Rockwell-Rimoldi S.p.A., Italy

[21] Appl. No.: 793,824

[22] Filed: Nov. 1, 1985

[30] Foreign Application Priority Data

May 27, 1985 [IT] Italy ..... 20910 A/85

[51] Int. Cl.[4] ..... D05B 55/14

[52] U.S. Cl. ..... 112/221; 74/600

[58] Field of Search ..... 74/600; 112/221

[56] References Cited

U.S. PATENT DOCUMENTS

| | | | |
|---|---|---|---|
| 2,932,268 | 4/1960 | Johnson | 112/221 |
| 3,492,959 | 2/1970 | Wenz et al. | 112/221 |
| 3,638,505 | 2/1972 | Wortley | 74/600 X |
| 3,653,346 | 4/1972 | Parsons | 112/221 X |
| 3,799,090 | 3/1974 | Sheroff | 112/221 |
| 3,857,345 | 12/1974 | Higgins | 112/221 X |

FOREIGN PATENT DOCUMENTS

| | | | |
|---|---|---|---|
| 57-173655 | 10/1982 | Japan | 74/600 |

*Primary Examiner*—Werner H. Schroeder
*Assistant Examiner*—Andrew M. Falik

[57] ABSTRACT

A needle bar actuating device for double chain stitch and/or overlock sewing machines provided with a driving crank, one crank pin of which has three angularly differentiated reference surfaces in order to define an equal number of positions and lengths for said driving crank with respect to its axis of rotation; to each of said positions and lengths corresponding a different predetermined stroke length of the needle bar.

1 Claim, 4 Drawing Figures

DEVICE PROVIDING FOR THREE SEWING MACHINE NEEDLE STROKES

BACKGROUND OF THE INVENTION

The invention relates to a needle bar actuating device for double thread chain stitch and/or overlock sewing machines and has a primary object the provision of means for adapting the needle bar stroke length to the thickness of the fabric being sewn.

The problem is solved by means of a device for actuating the travel of the needle, provided with a kinematic assembly comprising a connecting-rod component rotatably connected to the needle rod, a crank component integral with one end of a rotating shaft, and a device for joining together the said connecting-rod and crank components, which device consists substantially of two pins which are arranged in succession and are integral with each other and the respective axes of which are arranged so as to be mutually offset and parallel, a first pin being rotatably engaged with the said connecting-rod component and a second pin being movably engageable, via locking members, with the said crank component in a plurality of positions which differ angularly from each other.

As is known, sewing machines of the said type have a special device for actuating the travel of the needle, which is made and designed in different ways depending on the specific requirements and technical abilities. An actuating device is in fact known, in which the needle rod is connected to an actuating lever oscillating angularly about a pin lying perpendicularly to the needle rod.

The actuating lever is located inside the arm of the sewing machine and is made to oscillate by appropriate kinematic mechanisms which extend inside the column of the sewing machine. An actuating device is also known, in which the needle rod is made to move in a vertical direction by a shaft passing through the arm of the sewing machine and oscillating angularly about its own axis, owing to the action of a drive shaft extending in the base of the sewing machine.

Finally, an actuating device is known, in which the needle rod is operated by a secondary shaft which has a continuous rotating motion generated by a main shaft located in the base of the sewing machine. The secondary shaft is located in the arm of the sewing machine and an appropriate kinematic assembly transforms the rotating movement of the secondary shaft itself into an alternating rectilinear movement of the needle rod.

All the abovementioned and currently known actuating devices have the characteristic feature that they practically cannot be modified without taking steps comparable to partial restructuring of the sewing machines provided with the said devices. For this reason, the travel of the needle in known sewing machines must be considered a non-modifiable characteristic feature of the machines themselves, which is preset once and for all and in a definitive manner during the design and construction stages.

However, it is known that in the case of sewing machines designed to produce, for example, a chain stitch using one needle and two threads, the needle travel cannot be constant and fixed in all situations, but, on the contrary, must be adapted to the type of sewing operation which is to be performed.

In fact, when fabrics of considerable thickness are sewn, a relatively long needle travel is required so that the needle itself can be inserted and then removed with certainty from the fabric (extension of the travel upwards). On the other hand, short travel is required when fast stitches must be made on thin fabrics. In other situations, medium-length travel may be appropriate.

It must also be pointed out that potentially long travel is required when a so-called bottom covering stitch is to be performed, i.e. a particularly complicated chainstitch requiring a considerable amount of thread.

The need to vary the needle travel in accordance with the type of stitch which is to be performed obviously conflicts with the already mentioned impossibility of adjusting the parts of a sewing machine so as to increase or reduce the needle travel. It follows that, in the past, when it was not possible to use a medium-length travel setting which was substantially acceptable for the operations in question, it was necessary to purchase various sewing machine models which differed from each other with respect to the extent of the needle travel.

This situation is negative since it adversely affects not only production costs, when there is the practical need to purchase several sewing machines which differ only with respect to the needle travel, but also the quality of work, when a less than adequate needle travel is accepted or in fact used, with a consequent excessive supply of thread and loose sitches or insufficient supply of thread and stitches which are too tight.

The technical task underlying the present invention is therefore to overcome the abovementioned drawbacks of the known art, designing a sewing machine provided with an actuating device which is able to vary the needle travel as required.

Within the scope of this technical task, it is an important object of the present invention to design a device which has a simple structure, can be easily applied to the existing sewing machines and can be easily used even by untrained operators.

Another important object of the present invention is to design a device which, while being inexpensive, consists of a small number of components and allows the needle travel to be varied in accordance with a plurality of positions and in accordance with parameters which can be fixed with the greatest degree of accuracy.

SUMMARY OF THE INVENTION

The technical task mentioned and the objects proposed are substantially achieved by a device for actuating the travel of the needle in a sewing machine, of the type comprising a main shaft made to rotate by a motor, a secondary shaft with continuous rotary motion generated by the said main shaft, and a kinematic assembly designed to transform the rotary movement of the said secondary shaft into the alternating rectilinear movement of a needle rod perpendicular to the said secondary shaft, wherein the said kinematic assembly comprises a connecting-rod component rotatably connected to the said needle rod, a crank component integral with one end of the said secondary shaft, and a device for joining together the said connecting-rod and crank components, which device consists substantially of two pins which are arranged in succession and are integral with each other and the respective axes of which are arranged so as to be mutually offset and parallel, a first pin being rotatably engaged with the said connecting-rod component and a second pin being movably engageable, via locking members, with the said crank component in a plurality of positions which differ angularly from each other.

DESCRIPTION OF THE DRAWINGS

Further characteristic features and advantages will emerge more clearly from the description of a preferred but not exclusive embodiment of the invention, illustrated by way of an indicative and non-limiting example in the attached drawings in which.

DESCRIPTION OF THE INVENTION

Figure 1:
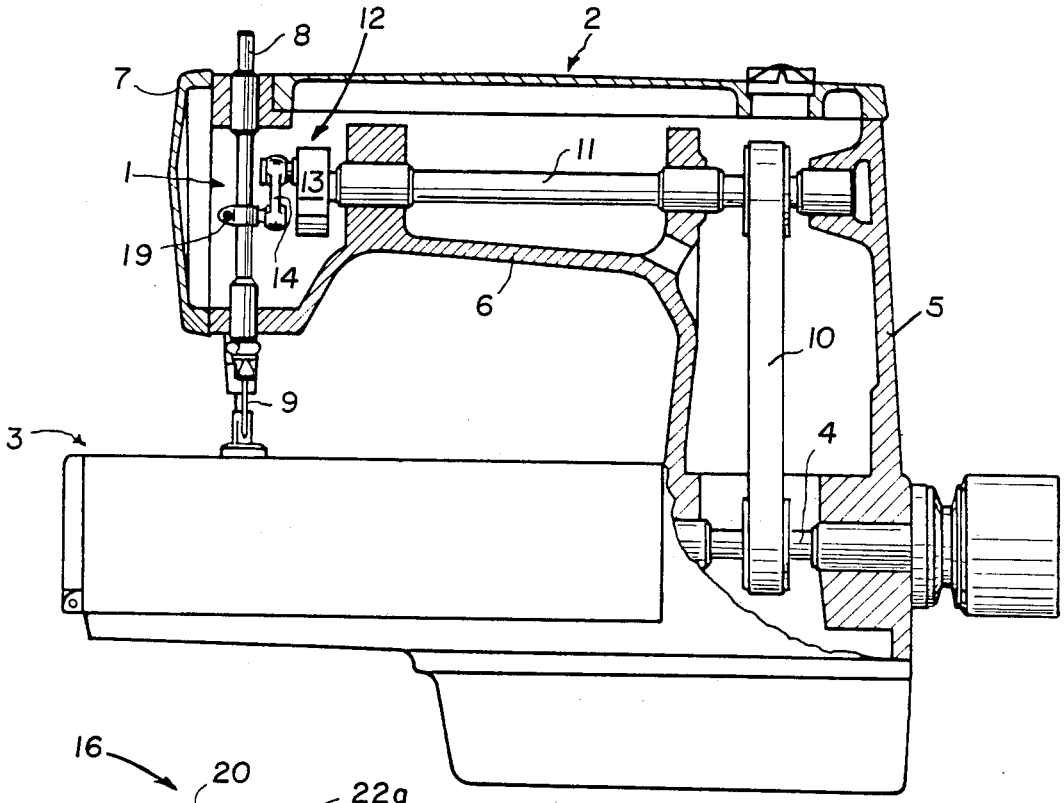
FIG. 1 shows, in elevation and in partial cross-section, a sewing machine equipped with the device according to the invention.
Figure 4:
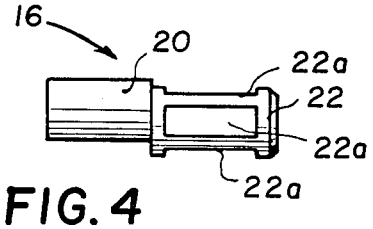
FIG. 4 shows in an isolated position a component of the device shown in FIG. 2.
Figure 3:
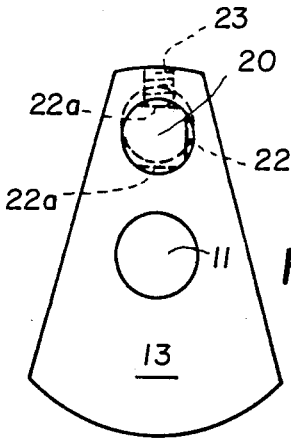
FIG. 3 is a side view of FIG. 2.

With reference to the figures mentioned, the actuating device according to the present invention, indicated by the reference numeral 1, is located inside a sewing machine 2, which, in many respects, is of a type known per se.

The sewing machine 2 comprises a base 3, a main shaft 4 located in the base 3, a column 5, an arm 6, and a headpiece 7 which has passing vertically through it a needle rod 8 carrying a needle 9 at the bottom.

The device 1 for actuating the travel of the needle 9 extends from the main shaft 4 and comprises a toothed belt 10 which, via two pulleys, connects the same main shaft 4 to a secondary shaft 11 located inside the arm 6, parallel to the main shaft 4. The secondary shaft 11 is perpendicular to the needle rod 8 and terminates in the vicinity of the latter, where a kinematic assembly 12 is provided, which assembly is designed to transform the rotary movement of the secondary shaft 11, generated by the main shaft 4 and by a motor driving the latter, into the alternating rectilinear movement of the needle rod 8.

Figure 2:
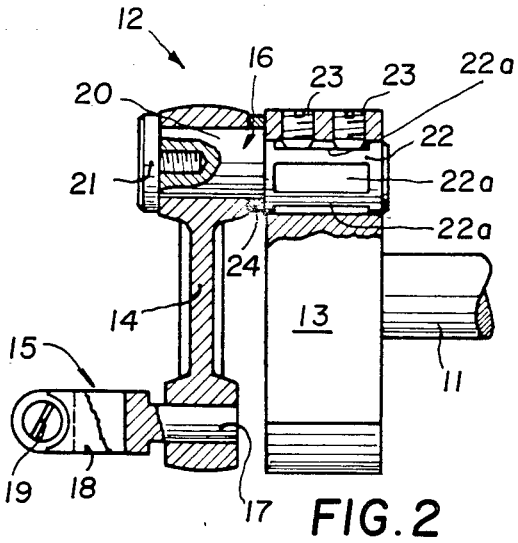
FIG. 2 shows the device according to the invention in isolation, with a partially sectioned view in elevation.

In an original manner, the kinematic assembly 12, shown in FIG. 2, comprises a crank component 13 consisting in practice of a counterweight integral with the secondary shaft 11, a connecting-rod component 14 rotatably engaged with an end component 15, and a coupling device 16 joining the connecting-rod component 14 and the crank component 13. The end component 15 consists of a gudgeon pin 17 rotatably engaged with the connecting-rod component 14 and a ring 18 which is integral with the gudgeon pin 17 and can be clamped on to the needle rod 8 by means of a screw 19.

The coupling device 16 consists of two pins which are arranged in succession and are integral with each other and the respective axes of which are arranged so as to be mutually offset and parallel. In particular, there is a first pin 20 which is rotatably arranged inside the connecting-rod component 14 and is axially locked in position by means of a locking screw 21, and a second pin 22 which can be secured inside the crank component 13. In order to fix the second pin 22 inside the crank component 13, movable locking members are provided, which are designed to fix the said second pin 22 in a plurality of positions at different angles or intervals with respect to each other. In the example shown, these locking members consist of a pair of grub screws 23 which are screwed inside the crank component 13 until they come up against the three flat surfaces of the second pin 22. These flat surfaces, which are substantially at 90° in relation to each other are indicated by *22a*.

A spacer disk or collar 24 may also be provided between the pins 20 and 22.

Operation of the actuating device according to the present invention is as follows:

The main shaft 4 transmits its rotary motion to the secondary shaft 11, via the belt 10. The rotary motion of the secondary shaft 11 is transformed into the alternating movement of the needle rod 8 by means of the kinematic assembly 12, i.e. by means of the connecting-rod component 14 and crank component 13.

However, the position of the connecting-rod component 14 in relation to the crank component 13 is not fixed: by suitably rotating the coupling device 16, the connecting-rod component 14 can be arranged more or less eccentrically in relation to the crank component 13. In fact, it is possible for the interval or displacement between the axes of the two pins 20 and 22 to be added to or subtracted from the distance between the axis of the secondary shaft 11 and the axis of the second pin 22. Intermediate positions are possible between these two end positions. The more eccentrically the connecting-rod component 14 is mounted on the crank component 13, in relation to the axis of the secondary shaft 11, the greater the travel of the needle rod 8.

Angular displacement of the coupling device 16 may be performed simply, by loosening the set screws 23 and suitably rotating the coupling device 16 itself, if necessary with the aid of special reference notches, and by then tightening again the set screws 23.

The position where the needle rod 8 is fixed to the connecting-rod component 14 may also be adjusted by loosening and tightening the screw 19.

The invention thus achieves the proposed objects. Attention is drawn to the simplicity, precision and practical nature of the device designed, as well as to the fact that it also allows the needle travel to be varied substantially by means of adjustments which are very simple and can be rapidly performed.

The invention thus conceived may be subject to numerous modifications and variations, all of which fall within the scope of the inventive idea.

Moreover, all the details may be replaced by technically equivalent elements.

In practice, the materials used, the forms and the dimensions ay be of any nature or magnitude, as required.

I claim:

1. In a double chain stitch and/or overlock sewing machine having a main shaft connected to a motor, a secondary shaft rotatably driven by the main shaft, a reciprocating needle bar disposed perpendicularly to the secondary shaft, a needle bar actuating device mounted on the secondary shaft having a crank provided with a crank pin, a link mounted on the crank pin to connect said crank to said needle bar for actuating the latter to move in reciprocating motion, the crank pin comprising first and second pins which are arranged in succession and mutually offset and parallel wherein said first pin is rotatably engaged with said link and said second pin is mounted on said crank and is formed with three angularly spaced flat surfaces, each of said three angularly spaced flat surfaces being fixable in one predetermined position with respect to said crank to reciprocate said needle bar in a predetermined different stroke length.

* * * * *